US009673510B2

(12) United States Patent
Lin

(10) Patent No.: US 9,673,510 B2
(45) Date of Patent: Jun. 6, 2017

(54) ANTENNA STRUCTURE AND WIRELESS COMMUNICATION DEVICE USING THE SAME

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 322 days.

(21) Appl. No.: 14/491,430

(22) Filed: Sep. 19, 2014

(65) Prior Publication Data

US 2015/0155616 A1 Jun. 4, 2015

(30) Foreign Application Priority Data

Nov. 30, 2013 (CN) ..... 2013 1 0623053

(51) Int. Cl.

| | |
|---|---|
| ***H01Q 1/24*** | (2006.01) |
| ***H01Q 9/42*** | (2006.01) |
| ***H01Q 5/371*** | (2015.01) |
| ***H01Q 5/378*** | (2015.01) |

(52) U.S. Cl.

CPC ..... *H01Q 1/243* (2013.01); *H01Q 5/371* (2015.01); *H01Q 5/378* (2015.01); *H01Q 9/42* (2013.01)

(58) Field of Classification Search

CPC ..... H01Q 1/243; H01Q 5/371; H01Q 5/378; H01Q 9/42

USPC ..... 343/702, 846

See application file for complete search history.

(56) References Cited

U.S. PATENT DOCUMENTS

| | | | | |
|---|---|---|---|---|
| 2004/0257283 | A1* | 12/2004 | Asano | H01Q 1/243 343/702 |
| 2005/0212706 | A1* | 9/2005 | Ying | H01Q 1/243 343/702 |
| 2012/0013511 | A1* | 1/2012 | Sumi | H01Q 1/243 343/702 |
| 2012/0262345 | A1* | 10/2012 | Kim | H01Q 1/243 343/702 |

* cited by examiner

*Primary Examiner* — Hoanganh Le

(74) *Attorney, Agent, or Firm* — Steven Reiss

(57) ABSTRACT

An antenna structure includes a first frame, a feed end, at least one ground end, a first radiator, a first extending section, a second extending section, a coupling section, and a second radiator. The first radiator is coupled to the feed end and is parallel to the first frame. The first extending section is coupled between the feed end and first frame. The second extending section is coupled between the feed end and the first frame. The coupling section is coupled to the first frame. The second radiator is coupled between the at least one ground end and the first frame.

19 Claims, 6 Drawing Sheets

ANTENNA STRUCTURE AND WIRELESS COMMUNICATION DEVICE USING THE SAME

FIELD

The disclosure generally relates to antenna structures, and particularly to a multiband antenna structure, and a wireless communication device using the same.

BACKGROUND

Antennas are used in wireless communication devices such as mobile phones. The wireless communication device uses a multiband antenna to receive/transmit wireless signals at different frequencies, such as wireless signals operated in an long term evolution (LTE) band.

BRIEF DESCRIPTION OF THE DRAWINGS

Implementations of the present technology will now be described, by way of example only, with reference to the attached figures.

DETAILED DESCRIPTION

Figure 1:
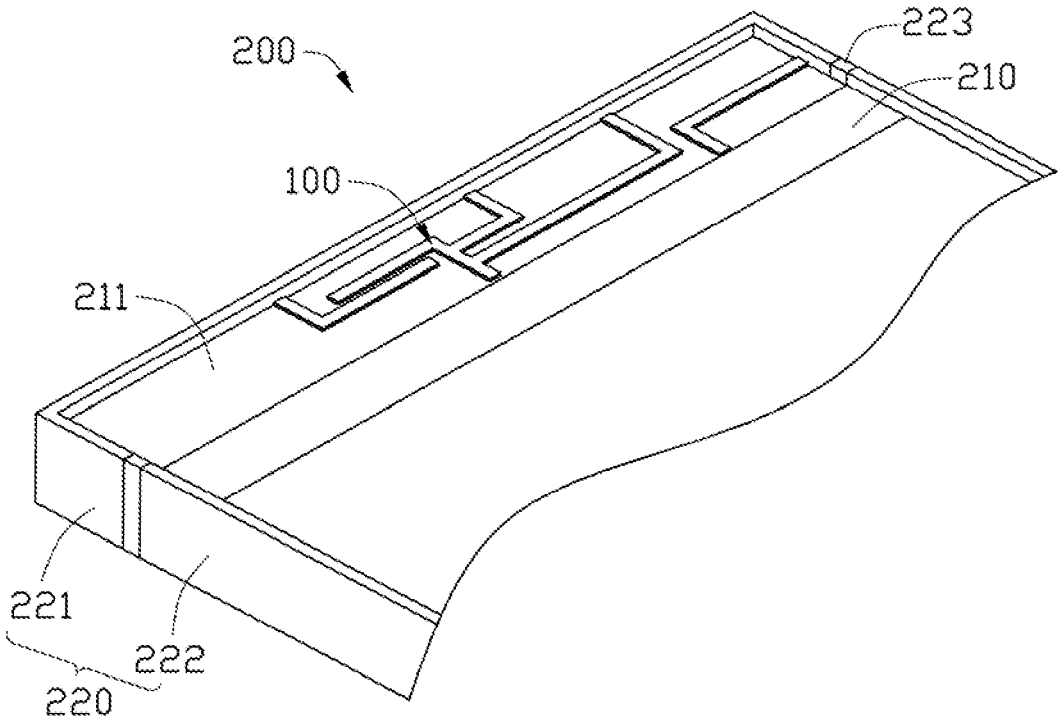
FIG. 1 is an isometric view of a wireless communication device employing an antenna structure, according to a first exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to an antenna structure and a wireless communication device using same.

Figure 2:
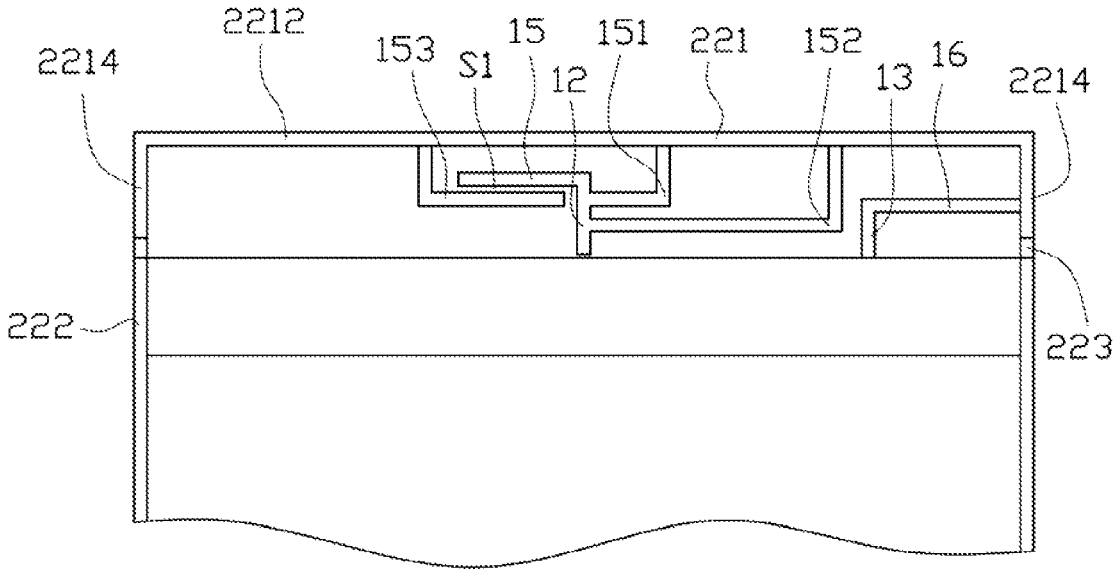
FIG. 2 is a diagrammatic view of the wireless communication device of FIG. 1.

FIGS. 1-2 illustrate an embodiment of a wireless communication device 200 employing an antenna structure 100, according to a first exemplary embodiment. The wireless communication device 200 can be a mobile phone, a tablet, or an intelligent watch, for example (details not shown). The wireless communication device 200 further includes a baseboard 210 and metallic housing 220 surrounding the baseboard 210.

The baseboard 210 can be a printed circuit board (PCB) of the wireless communication device 200. The baseboard 210 forms a keep-out-zone 211. The purpose of the keep-out-zone 211 is to delineate an area on the PCB 210 in which other electronic components (such as a camera, a vibrator, a speaker, etc.) cannot be placed. In at least one embodiment, the keep-out-zone 211 is disposed on an end of the PCB 210. Two gaps 223 are defined on the metallic housing 220 to divide the metallic housing 220 into a first frame 221 and a second frame 222. The first frame 221 is disposed on peripheral sides of the keep-out-zone 211, and is served as a part of the antenna structure 100. In at least one embodiment, a width of the gap 223 can be about 1.5 mm. In addition, the first frame 221 includes a main section 2212 and two connection sections 2214 connected to two opposite ends of the main section 2212.

The antenna structure 100 further includes a feed end 12, a first ground end 13, a first radiator 15, a first extending section 151, a second extending section 152, a coupling section 153, and a second radiator 16.

The feed end 12 is parallel to the first ground end 13, and both the feed end 12 and the first ground end 13 are perpendicular to the main section 2212 of the first frame 221. The feed end 12 is coupled to a feed pin of the PCB 210 to receive signals, and the first ground end 13 is coupled to a ground pin of the PCB 210. Thus, the antenna structure 100 can be grounded.

The first radiator 15 is perpendicularly connected to a distal end of the feed end 12, and extends parallel to the main section 2212 of the first frame 221. The first extending section 151 is substantially an L-shaped sheet, a first portion of the first extending section 151 is perpendicularly connected to the feed end 12 and extends parallel to the main section 2212 of the first frame 221, and a second portion of the first extending section 151 extends perpendicular to the main section 2212 and is coupled to the main section 2212. The second extending section 152 is substantially an L-shaped sheet. A first portion of the second extending section 152 is perpendicularly connected to the feed end 12 and extends parallel to the first portion of the first extending section 151. A second portion of the second extending section 152 extends parallel to the second portion of the first extending section 151 and is coupled to the main section 2212. In at least one embodiment, a length of the second extending section 152 is greater than a length of the first extending section 151. That is, the first portion of the second extending section 152 is parallel to the first portion of the first extending section 151 and has a greater length than that of the first portion of the first extending section 151, the second portion of second extending section 152 is parallel to the second portion of the first extending section 151 and has a greater length than that of the second portion of the first extending section 151.

The coupling section 153 is substantially an L-shaped sheet. A first portion of the coupling section 153 is coupled to the main section 2212 of the first frame 221, and a second portion of the coupling section 153 is parallel to the first radiator 15. Thus, a slot S1 is defined between the second portion of the coupling section 153 and the first radiator 15. In at least one embodiment, a width of the slot S1 can be about 0.6 mm.

The second radiator 16 is perpendicularly connected between a distal end of the first ground end 13 and one of two connection sections 2214.

When current is input to the feed end 12, the current flows to the first radiator 15, the first extending section 151, the second extending section 152, the coupling section 153, the first frame 221, and the second radiator 16 to form a first current path for resonating a first low frequency mode. Additionally, the current flows to the first radiator 15 and the coupling section 153 to form a second current path for resonating a first high frequency mode. Furthermore, the current flows to the first extending section 151, the first frame 221, and the second radiator 16 to form a third current path for resonating a second high frequency mode. In at least one embodiment, a central frequency of the first low frequency mode can be, for example, about 850 MHz, a central frequency of the first high frequency mode can be, for example, about 1750 MHz, and a central frequency of the second high frequency mode can be, for example, about 2000 MHz.

Figure 3:
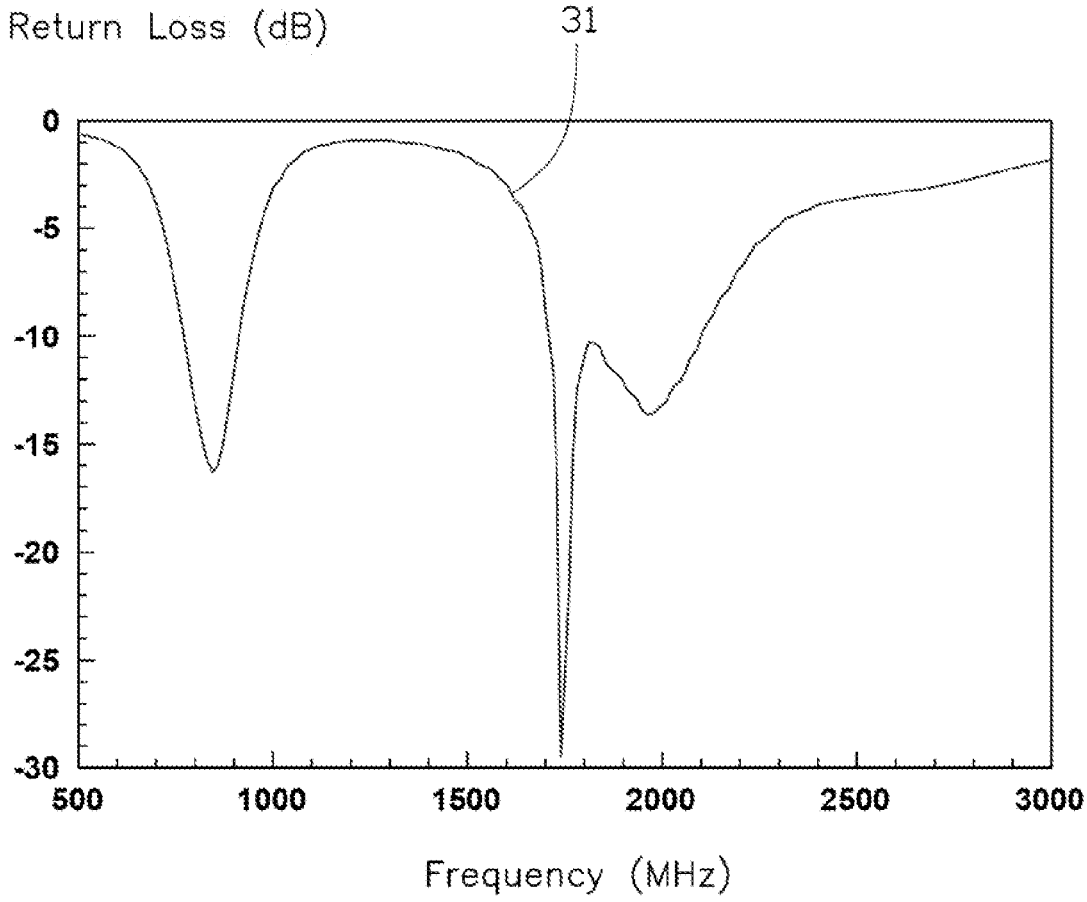
FIG. 3 is a return loss (RL) graph of the antenna structure of FIG. 1.

FIG. 3 illustrates a return loss (RL) curve 31 of the antenna structure 100. When a length of the first radiator 15 is about 10 mm, a length of the first extending section 151 is about 10 mm, a length of the second extending section 152 is about 25 mm, a length of the coupling section 153 is about 14 mm, and a total length of the second radiator 16 and the first ground end 13 is about 14 mm, the antenna structure 100 is activated to receive and transmit wireless signals at a first bandwidth which can be for example about 720-960 MHz and a second bandwidth which can be for example about 1710-2170 MHz. At this time, a value of the RL is less than −6 dB.

Figure 4:
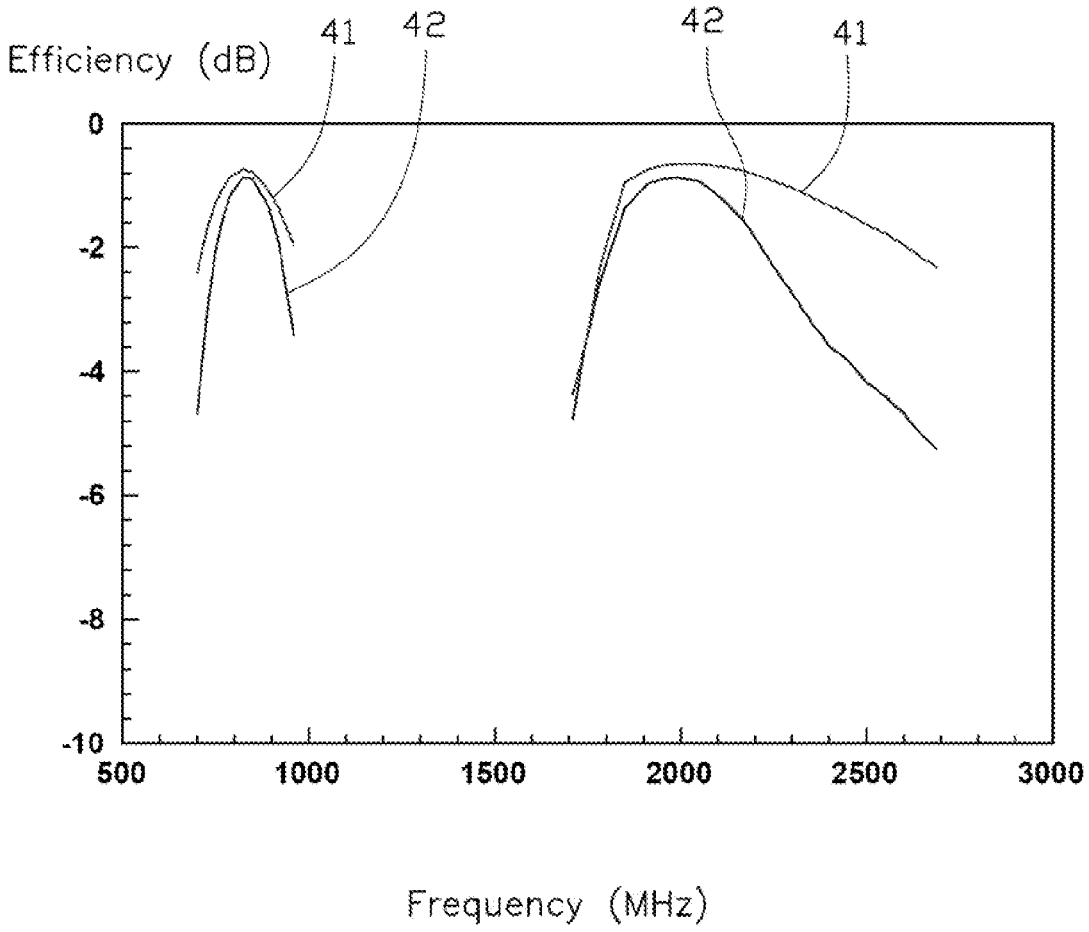
FIG. 4 is an antenna efficiency graph of the antenna structure of FIG. 1.

FIG. 4 illustrates an antenna efficiency of the antenna structure 100. A first antenna efficiency curve 41 indicates a radiation efficiency of the antenna structure 100, and a second antenna efficiency curve 42 indicates a total efficiency of the antenna structure 100. In view of the curves 41 and 42, the wireless communication device 200 has good performance when operating at 720-960 MHZ and 1710-2170 MHZ.

Figure 5:
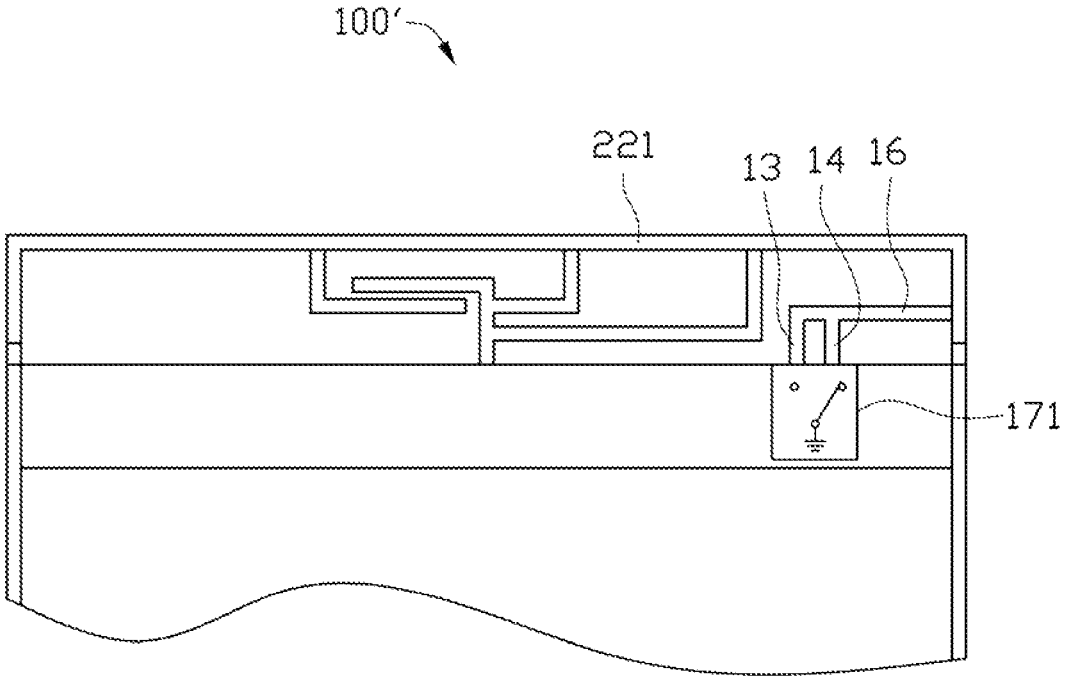
FIG. 5 is a diagrammatic view of a wireless communication device, according to a second exemplary embodiment.

FIG. 5 illustrates an embodiment of an antenna structure 100', according to a second exemplary embodiment. The antenna structure 100' of the second exemplary embodiment is substantially same to the antenna structure 100 illustrated in the first exemplary embodiment, and a difference between the antenna structure 100' and the antenna structure 100 is that a second ground end 14 and a first switching circuit 171 are involved in the antenna structure 100'. The second ground end 14 is coupled to the second radiator 16, and is parallel to the first ground end 13. The first switching circuit 171 is grounded, and is selectively coupled to the first ground end 13 and the second ground end 14. When the first switching circuit 171 is coupled to the second ground end 14, the antenna structure 100' is activated to receive and transmit wireless signals at another bandwidth, which can be for example about 2200-2700 MHz.

Figure 6:
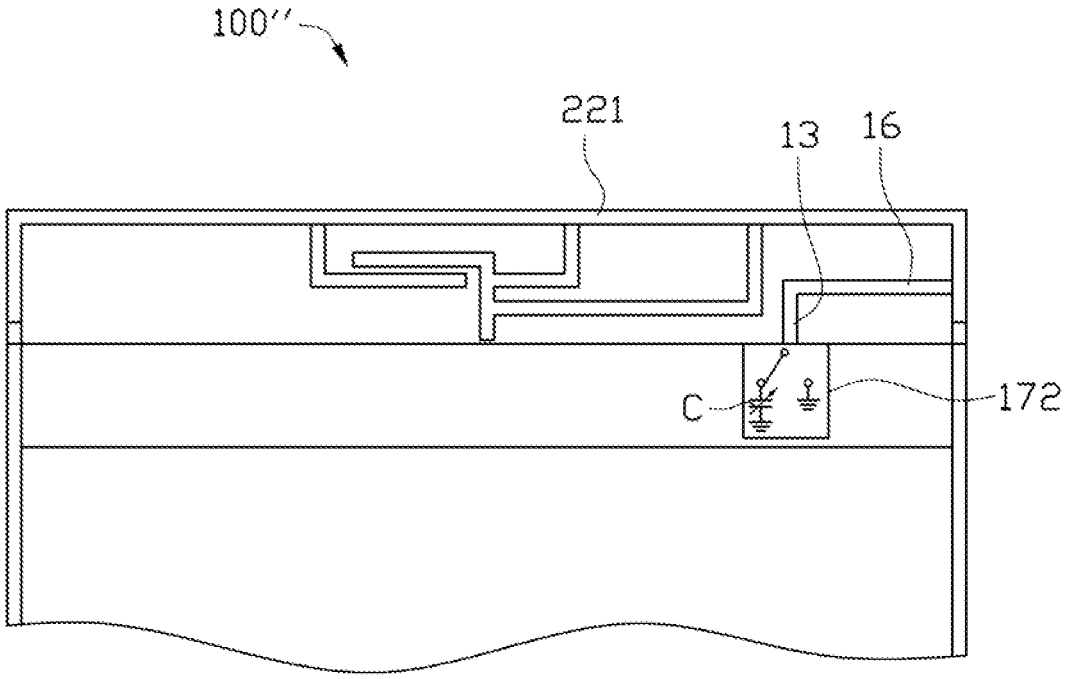
FIG. 6 is a diagrammatic view of a wireless communication device, according to a third exemplary embodiment.

FIG. 6 illustrates an embodiment of an antenna structure 100", according to a third exemplary embodiment. The antenna structure 100" of the third exemplary embodiment is substantially same to the antenna structure 100 illustrated in the first exemplary embodiment, and a difference between the antenna structure 100" and the antenna structure 100 is that a second switching circuit 172 and a variable capacitor C are involved in the antenna structure 100". The second switching circuit 172 is coupled to the first ground end 13, and is selectively coupled to ground and the variable capacitor C. The second high frequency mode can be adjusted by changing a value of the variable capacitor C. In at least one embodiment, a central frequency of the second high frequency mode can be, for example, about 2200-2700 MHz.

In other embodiments, the second switching circuit 172 and the variable capacitor C can also be involved in the antenna structure 100', and the first switching circuit 171 of the antenna structure 100' can be omitted. The second switching circuit 172 is coupled to the first ground end 13 and the second ground end 14. Thus, one of the first ground end 13 and the second ground end 14 can be ground via the second switching circuit 172 or via both the second switching circuit 172 and the variable capacitor C.

In summary, the first frame 221 is configured to a part of the antenna structure 100, 100', 100", which allows further size reductions of the wireless communication device 200 employing the antenna structure 100, 100', 100". In addition, a radiating capability of the antenna structure 100, 100', 100" of the wireless communication device 200 is effectively improved because of the first switching circuit 171 and the second switching circuit 172.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure used in a wireless communication device having a first frame, the antenna structure comprising:

a feed end;

at least one ground end;

a first radiator coupled to the feed end and parallel to the first frame;

a first extending section, a first portion of the first extending section directly coupled to the feed end and a second portion of the first extending section coupled to the first frame;

a second extending section coupled between the feed end and the first frame;

a coupling section coupled to the first frame; and a second radiator, one end of the second radiator directly coupled to the at least one ground end and another end of the second radiator coupled to the first frame.

2. The antenna structure as claimed in claim 1, wherein the first frame comprises a main section and two connection sections, the two connection sections are connected to two opposite ends of the main section.

3. The antenna structure as claimed in claim 2, wherein the first extending section is substantially an L-shaped sheet, the first portion of the first extending section is perpendicularly connected to the feed end and extends parallel to the main section of the first frame, and the second portion of the first extending section extends perpendicular to the main section and is coupled to the main section.

4. The antenna structure as claimed in claim 3, wherein the second extending section is substantially an L-shaped sheet, a first portion of the second extending section extends parallel to the first portion of the first extending section, a second portion of the second extending section extends parallel to the second portion of the first extending section and is coupled to the main section.

5. The antenna structure as claimed in claim 2, wherein the first radiator is perpendicularly connected to one end of the feed end, the second radiator is substantially an L-shaped sheet, a first portion of the second radiator is perpendicularly connected to the ground end and extends parallel to the connection section of the first frame, and a second portion of the second radiator extends parallel to the main section and is coupled to the connection section.

6. The antenna structure as claimed in claim 1, wherein the coupling section is substantially an L-shaped sheet, a first portion of the coupling section is coupled to the main section of the first frame, a second portion of the coupling section is parallel to the first radiator, and a slot is defined between the second portion of the coupling section and the first radiator.

7. The antenna structure as claimed in claim 1, further comprising a first switching circuit, wherein the at least one of the ground end comprises a first ground end and a second ground end parallel to the first ground end, the first switching circuit is grounded, and is selectively coupled to the first ground end and the second ground end.

8. The antenna structure as claimed in claim 1, further comprising a second switching circuit and a variable capacitor, wherein the at least one of the ground end comprises a first ground end, the second switching circuit is coupled to the first ground end, and is selectively coupled to ground and the variable capacitor.

9. The antenna structure as claimed in claim 1, wherein the feed end, the at least one ground end, the first radiator, the first extending section, the second extending section, the coupling section, and the second radiator are coplanar.

10. A wireless communication device, comprising:

a metallic housing comprising a first frame; and an antenna structure comprising:

a feed end;

at least one ground end;

a first radiator coupled to the feed end and parallel to the first frame;

a first extending section, a first portion of the first extending section directly coupled to the feed end and a second portion of the first extending section coupled to the first frame;

a second extending section coupled between the feed end and the first frame;

a coupling section coupled to the first frame; and a second radiator, one end of the second radiator directly coupled to the at least one ground end and another end of the second radiator coupled to the first frame.

11. The wireless communication device as claimed in claim 10, wherein the first frame comprises a main section and two connection sections, the two connection sections are connected to two opposite ends of the main section.

12. The wireless communication device as claimed in claim 11, wherein the first extending section is substantially an L-shaped sheet, the first portion of the first extending section extends parallel to the main section of the first frame, and the second portion of the first extending section extends perpendicular to the main section and is coupled to the main section.

13. The wireless communication device as claimed in claim 12, wherein the second extending section is substantially an L-shaped sheet, a first portion of the second extending section is perpendicularly connected to the feed end and extends parallel to the first portion of the first extending section, a second portion of the second extending section extends parallel to the second portion of the first extending section and is coupled to the main section.

14. The wireless communication device as claimed in claim 11, wherein the first radiator is perpendicularly connected to one end of the feed end, the second radiator is substantially an L-shaped sheet, a first portion of the second radiator is perpendicularly connected to the ground end and extends parallel to the connection section of the first frame, and a second portion of the second radiator extends parallel to the main section and is coupled to the connection section.

15. The wireless communication device as claimed in claim 10, wherein the coupling section is substantially an L-shaped sheet, a first portion of the coupling section is coupled to the main section of the first frame, a second portion of the coupling section is parallel to the first radiator, and a slot is defined between the second portion of the coupling section and the first radiator.

16. The wireless communication device as claimed in claim 10, wherein the antenna structure further comprises a first switching circuit, the at least one of the ground end comprises a first ground end and a second ground end parallel to the first ground end, the first switching circuit is grounded, and is selectively coupled to the first ground end and the second ground end.

17. The wireless communication device as claimed in claim 10, the antenna structure further comprises a second switching circuit and a variable capacitor, the at least one of the ground end comprises a first ground end, the second switching circuit is coupled to the first ground end, and is selectively coupled to ground and the variable capacitor.

18. The wireless communication device as claimed in claim 10, further comprising a baseboard, wherein the baseboard forms a keep-out-zone, the first frame is disposed on peripheral sides of the keep-out-zone.

19. The wireless communication device as claimed in claim 10, wherein the feed end, the at least one ground end, the first radiator, the first extending section, the second extending section, the coupling section, and the second radiator are coplanar.

* * * * *